US010502402B2

(12) United States Patent
Rocchio et al.

(10) Patent No.: US 10,502,402 B2
(45) Date of Patent: Dec. 10, 2019

(54) LIGHTING EXTENSION DEVICES AND METHODS

(71) Applicant: RAB Lighting Inc., Northvale, NJ (US)

(72) Inventors: Pasquale Rocchio, Norwood, NJ (US); Vincenzo Guercio, Wallkill, NY (US)

(73) Assignee: RAB Lighting Inc., Northvale, NJ (US)

( * ) Notice: Subject to any disclaimer, the term of this patent is extended or adjusted under 35 U.S.C. 154(b) by 261 days.

(21) Appl. No.: 15/440,207

(22) Filed: Feb. 23, 2017

(65) Prior Publication Data

US 2018/0238526 A1 Aug. 23, 2018

(51) Int. Cl.

| | |
|---|---|
| ***F21V 21/22*** | (2006.01) |
| ***F21V 21/108*** | (2006.01) |
| *F21V 21/116* | (2006.01) |
| *F21V 21/30* | (2006.01) |
| *F21V 23/04* | (2006.01) |

(52) U.S. Cl.

CPC ..... *F21V 21/22* (2013.01); *F21V 21/108* (2013.01); *F21V 21/116* (2013.01); *F21V 21/30* (2013.01); *F21V 23/0442* (2013.01)

(58) Field of Classification Search

CPC ..... F21V 21/26; F21V 21/088; F21V 21/108; F21V 21/22

See application file for complete search history.

(56) References Cited

U.S. PATENT DOCUMENTS

| | | | | |
|---|---|---|---|---|
| 4,238,818 A * | 12/1980 | Gindel | F21V 21/22 | 362/285 |
| 5,236,160 A * | 8/1993 | Sechelski | F21L 14/00 | 248/125.1 |
| 5,424,931 A * | 6/1995 | Wheeler | F21S 6/006 | 362/249.1 |
| 5,504,665 A * | 4/1996 | Osteen | F21V 21/26 | 362/269 |
| 6,234,509 B1 * | 5/2001 | Lara | B60D 1/06 | 280/425.2 |

(Continued)

FOREIGN PATENT DOCUMENTS

| | | |
|---|---|---|
| CN | 201225586 | 4/2009 |
| CN | 103672709 | 3/2014 |

(Continued)

*Primary Examiner* — Daniel J Wiley

(74) *Attorney, Agent, or Firm* — Frost Brown Todd LLC; Douglas G. Gallagher; Kevin C. Oschman

(57) ABSTRACT

An extendable connector for connecting a lighting accessory to a lighting fixture and methods for manufacturing or installing the same are disclosed. Embodiments of the extension device include an adjustable extension device that may be assembled by hand, optionally after threading wiring connecting the lighting accessory to the lighting fixture through the individual components. Some embodiments include a telescoping extension device with a connector for connecting to a lighting fixture that snap-fits to and rotates in relation to one of the telescoping members. Additional embodiments include a connector for connecting to a lighting accessory that snap-fits to and is rotationally engaged with one of the telescoping members, and can engage with a locking member to set the orientation of the lighting accessory in relation to the telescoping member. Further embodiments include a locking member enabling the user to set the length of the extendable connector.

22 Claims, 2 Drawing Sheets

(56) References Cited

U.S. PATENT DOCUMENTS

| | | | | |
|---|---|---|---|---|
| 6,416,207 | B1 * | 7/2002 | Chang | F21S 6/003 362/249.07 |
| 7,322,735 | B1 * | 1/2008 | Caldani | F21V 21/22 362/285 |
| 7,572,024 | B2 | 8/2009 | Ko et al. | |
| 7,971,839 | B2 | 7/2011 | Upchurch | |
| 8,033,833 | B1 | 10/2011 | Lai | |
| 9,285,111 | B2 | 3/2016 | Todd | |
| 2004/0233676 | A1 * | 11/2004 | Matts | F16C 11/103 362/418 |
| 2013/0322100 | A1 * | 12/2013 | Lowry | F21V 17/10 362/427 |
| 2017/0167695 | A1 * | 6/2017 | Erdener | H05B 33/0845 |

FOREIGN PATENT DOCUMENTS

| | | |
|---|---|---|
| CN | 105476823 | 4/2016 |
| CN | 105698053 | 6/2016 |
| CN | 205664242 | 10/2016 |
| CN | 205677343 | 11/2016 |

* cited by examiner

LIGHTING EXTENSION DEVICES AND METHODS

FIELD

Embodiments of this disclosure relate generally to lighting fixtures, and more particularly, to extension devices and methods for connecting a lighting accessory to a lighting fixture.

BACKGROUND

Lighting accessories, such as motion detectors, lighting controllers, heat sensors, light sensors and the like, can be used with various lighting fixtures. One example includes using a lighting accessory with a high-bay lighting fixture, which is typically suspended from relatively high ceiling (such as in a warehouse) placing the lighting fixture closer to the floor where people will be working and where the light will be required. However, it was realized by the inventors of the current disclosure that problems exist with connecting lighting accessories to lighting fixtures, such as high-bay lighting fixtures, and that improvements in lighting accessory connection and extension devices are needed. Example problems realized include there being a limited selection of lengths that a lighting accessory can be separated from a lighting fixture when connected to the lighting fixture, and extension devices interfering with the operation of the sensor or the lighting fixture. Certain features of the present disclosure address these and other needs and provide other important advantages.

SUMMARY

Embodiments of the present disclosure provide improved lighting extension devices and methods.

The inventors of the current disclosure realized that having a limited number of distances that sensors can be extended from a lighting fixture when connected to the lighting fixture can be problematic. For example, if a sensor is positioned too far below a high-bay lighting fixture, the accessory can cast an undesirable shadow. Conversely, if the fixture is positioned too high, it may be above the point where the accessory casts a shadow, but the accessory may react to (e.g., trigger off) the light being emitted from the high-bay lighting fixture. When extension devices that have a limited selection for extension distances are used, a user may be unable to establish an appropriate distance below the lighting fixture to install the lighting accessory. As such, having an infinitely adjustable extension device has advantages.

Moreover, extension devices with a plurality of apertures defining where an accessory can be connected can result in the extension device extending downward below the lighting accessory (such as when the accessory is attached to an aperture that is not located adjacent the bottom end of the extension device) which can be aesthetically displeasing and unnecessarily cast a shadow.

This summary is provided to introduce a selection of the concepts that are described in further detail in the detailed description and drawings contained herein. This summary is not intended to identify any primary or essential features of the claimed subject matter. Some or all of the described features may be present in the corresponding independent or dependent claims, but should not be construed to be a limitation unless expressly recited in a particular claim. Each embodiment described herein does not necessarily address every object described herein, and each embodiment does not necessarily include each feature described. Other forms, embodiments, objects, advantages, benefits, features, and aspects of the present disclosure will become apparent to one of skill in the art from the detailed description and drawings contained herein. Moreover, the various apparatuses and methods described in this summary section, as well as elsewhere in this application, can be expressed as a large number of different combinations and subcombinations. All such useful, novel, and inventive combinations and subcombinations are contemplated herein, it being recognized that the explicit expression of each of these combinations is unnecessary.

BRIEF DESCRIPTION OF THE DRAWINGS

Some of the figures shown herein may include dimensions or may have been created from scaled drawings. However, such dimensions, or the relative scaling within a figure, are by way of example, and not to be construed as limiting.

DETAILED DESCRIPTION OF THE ILLUSTRATED EMBODIMENTS

Figure 1:
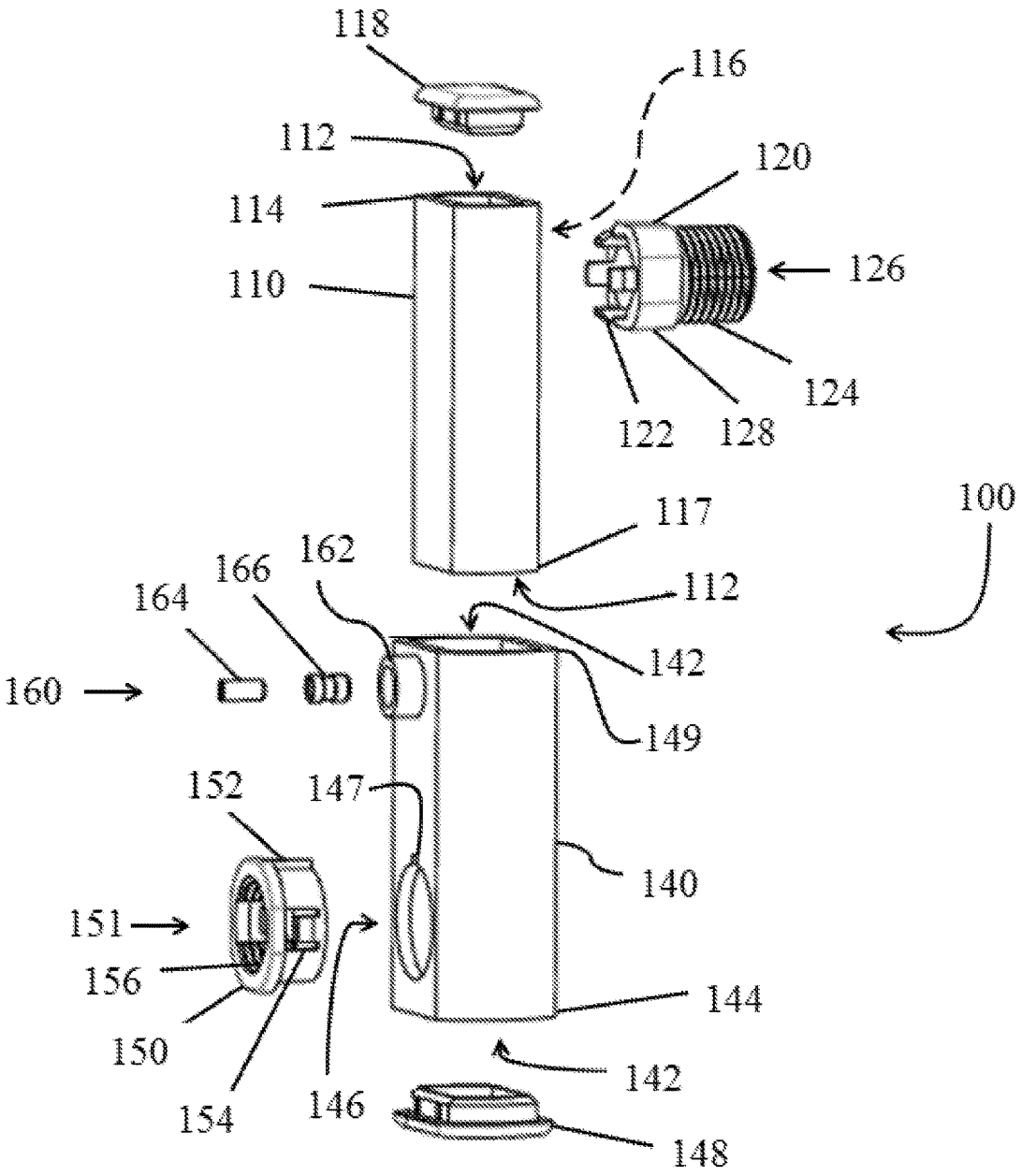
FIG. 1 is an exploded, perspective view of an extension device according to one embodiment of the present disclosure.

For the purposes of promoting an understanding of the principles of the disclosure, reference will now be made to one or more embodiments, which may or may not be illustrated in the drawings, and specific language will be used to describe the same. It will nevertheless be understood that no limitation of the scope of the disclosure is thereby intended; any alterations and further modifications of the described or illustrated embodiments, and any further applications of the principles of the disclosure as illustrated herein are contemplated as would normally occur to one skilled in the art to which the disclosure relates. At least one embodiment of the disclosure is shown in great detail, although it will be apparent to those skilled in the relevant art that some features or some combinations of features may not be shown for the sake of clarity.

Any reference to "invention" within this document is a reference to an embodiment of a family of inventions, with no single embodiment including features that are necessarily included in all embodiments, unless otherwise stated. Furthermore, although there may be references to benefits or advantages provided by some embodiments, other embodiments may not include those same benefits or advantages, or may include different benefits or advantages. Any benefits or advantages described herein are not to be construed as limiting to any of the claims.

Likewise, there may be discussion with regards to "objects" associated with some embodiments of the present invention, it is understood that yet other embodiments may not be associated with those same objects, or may include yet different objects. Any advantages, objects, or similar words used herein are not to be construed as limiting to any of the claims. The usage of words indicating preference, such as "preferably," refers to features and aspects that are present in at least one embodiment, but which are optional for some embodiments.

Specific quantities (spatial dimensions, temperatures, pressures, times, force, resistance, current, voltage, concentrations, wavelengths, frequencies, heat transfer coefficients, dimensionless parameters, etc.) may be used explicitly or implicitly herein, such specific quantities are presented as examples only and are approximate values unless otherwise indicated. Discussions pertaining to specific compositions of matter, if present, are presented as examples only and do not limit the applicability of other compositions of matter, especially other compositions of matter with similar properties, unless otherwise indicated.

Embodiments of the present disclosure include lighting fixture extension devices and methods for attaching an accessory to a lighting fixture. In one embodiment, a lighting fixture extension device is configured and adapted to mount a lighting accessory (e.g., a light sensor, a motion detector, a heat sensor, or a lighting controller) to a lighting fixture (e.g., a high-bay lighting fixture) enabling a user to adjust the distance from (e.g., below) the lighting fixture that the lighting accessory is positioned.

Figure 2:
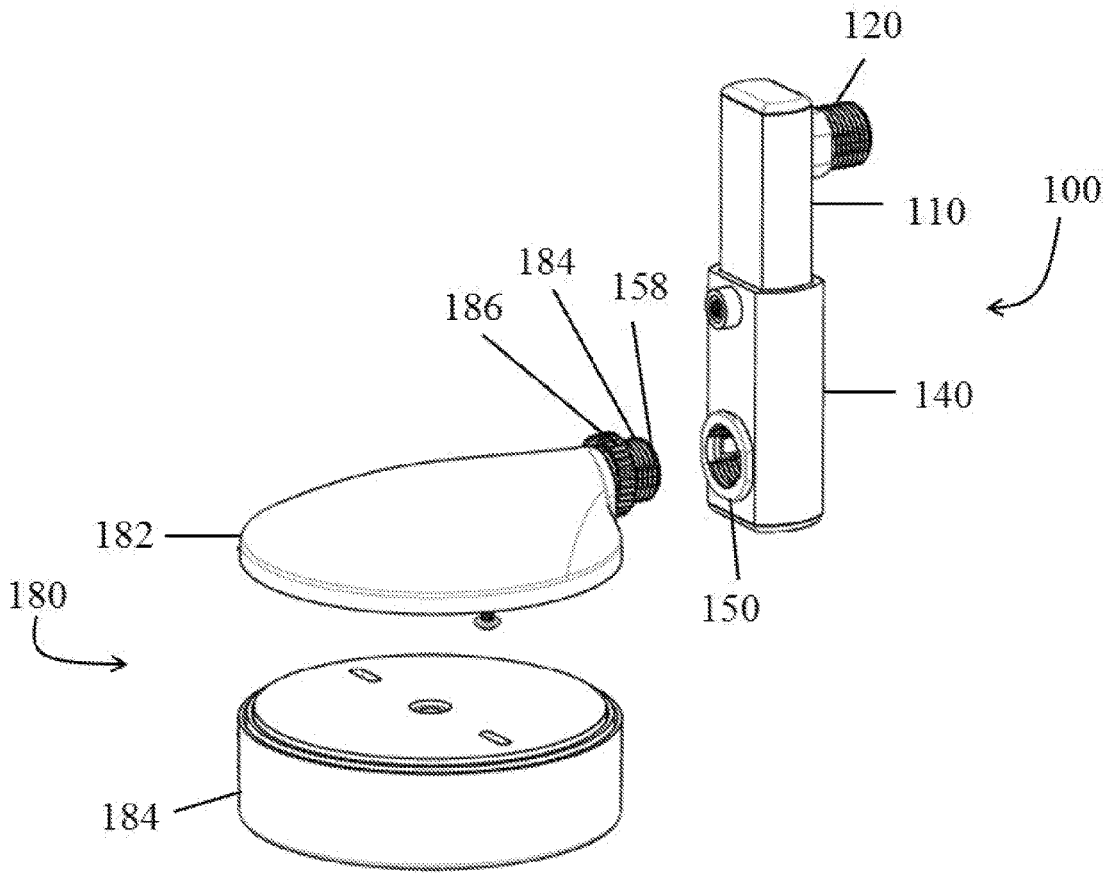
FIG. 2 is a perspective view of the extension device depicted in FIG. 1 in an assembled configuration and a connector attached to a lighting accessory according to one embodiment of the present disclosure.

Depicted in FIGS. 1 and 2 is an extension device 100 according a first embodiment of the present disclosure. Extension device 100 includes a first extension member (e.g., first telescoping member 110) and a second extension member (e.g., second telescoping member 140) that connect to one another to permit a variety of overall lengths for extension device 100. First telescoping member 110 may be either the inner or outer portion of the telescoping arrangement with the second telescoping member 140. For outdoor applications, it can be preferable for the upper telescoping member to be the outer portion to inhibit water intrusion.

First telescoping member 110 is generally cylindrical in shape with an aperture 112 extending along the length of telescoping member 110 to accommodate passage of electrical wires. In the illustrated embodiment, first telescoping member 110 is depicted as a hollow tube with aperture 112 extending through the entire length of first telescoping member 110, which may be useful to simplify the manufacturing process. However, the first end 114 of first telescoping member 110 may be closed with aperture 112 being located only at the end of the first telescoping member 110 that connects to the second telescoping member 140 (e.g., second end 117), extending to aperture 116, and ending at the first end 114. However, in the illustrated embodiment aperture 112 extends through the entire length of first telescoping member 110 and an optional end cap 118 can be used to close aperture 112 at the first end 114 of first telescoping member 110, which may be useful to prevent foreign material from entering extension device 100.

First telescoping member 110 also includes an aperture (e.g., aperture 116) in an external surface of first telescoping member 110. Aperture 116 is configured to receive a connector 120, which may be used to attach extension 100 to a lighting fixture (or, alternatively, to a lighting accessory). Connector 120 includes a fitting 122 that cooperates with aperture 116 of first telescoping member 110 to connect connector 120 to first telescoping member 110. In at least one embodiment, fitting 122 and aperture 116 allow rotation of connector 120 when connector 120 is connected to the first telescoping member 110. In some embodiments, such as the embodiment depicted in FIG. 1, fitting 122 is a snap-fitting allowing a user to hand press connector 120 into aperture 116 without requiring rotation of connector 120 to form a secure connection between connector 120 and first telescoping member 110, which in some embodiments allows rotation of connector 120 in relation to first telescoping member 110. Aperture 116 can be a circular aperture and can alternatively include registering features similar to the keyed portions associated with connector 150 as discussed below or by having a non-circular shape.

Connector 120 includes a fitting 124 for connecting connector 120 to a lighting device (e.g., a lighting fixture or a lighting accessory). The connector 120 is configured to connect with a portion of a lighting fixture (or, alternatively, a lighting accessory). For example, connector 120 may include threads that cooperate with threads of the lighting fixture, although other embodiments include non-threaded connections (such as rotatable snap-fittings and non-rotatable snap-fittings) between connector 120 and the lighting fixture (or lighting accessory). While the illustrated embodiment depicts connector 120 as including the male portion, indicating the lighting fixture includes the female portion of the connection between connector 120 and the lighting fixture, alternate embodiments of connector 120 include a female portion.

Connector 120 further defines an aperture 126 extending the length of connector 120 to accommodate the passage of electrical wires. In at least one embodiment, the outer surface 128 of connector 120 is shaped to facilitate rotation of connector 120 in relation to first telescoping member 110, such as by including knurling or by shaping outer surface 128 to accept a tool (e.g., a wrench) as illustrated in FIG. 1.

Second telescoping member 140 can be a hollow tube with an aperture 142 extending the length of second telescoping member 140 to accommodate the passage of electrical wires. Alternate embodiments of second telescoping member 140 include a first end 144 that is closed with aperture 142 extending from the end of second telescoping member 140 that engages first telescoping member 110 (e.g., second end 149) to aperture 146, and ending at the closed first end 144. An optional end cap 148 may be used to close-off first end 144 of second telescoping member 140 when aperture 142 extends the entire length of second telescoping member 140, such as to prevent foreign material from entering extension device 100. The use of cap 148 allows for a simplified manufacturing process for second telescoping member 140 since second telescoping 140 may be initially formed as a hollow cylinder.

Second telescoping member 140 includes an aperture 146 for connecting second telescoping member 140 to a lighting accessory (or possibly a lighting fixture) for the passage of wires from the lighting accessory, through aperture 146, and through the first telescoping member. Aperture 146 is illustrated as being configured for connection of a connector that does not rotate with respect to aperture 146 and second telescoping member 140, although alternate embodiments include an aperture 146 that permits rotation of a fitting connected to aperture 146. Aperture 146 optionally includes a keyed portion (e.g., a key receptacle (such as notch 147), a non-circular shape, or, alternatively, a key) configured to cooperate with a keyed portion of connector 150 (e.g., key 152, a non-circular shape, or, alternatively, a notch 147) to inhibit rotation of connector 150 with respect to aperture 146 and second telescoping member 140.

Connector 150 includes an aperture 151 for passage of electrical wires from the lighting accessory, through connector 150, and into second telescoping member 140. Connector 150 also includes a fitting for connecting connector 150 to aperture 146 in first telescoping member 140. For example, in the illustrated embodiment fitting 154 is a snap-fitting allowing a user to insert connector 150 into aperture 146 and connect connector 150 to second telescoping member 140 by hand without requiring rotation of connector 150. Connector 150 optionally includes a keyed portion (as discussed above), such as key 152, that can cooperate with a complimentary keyed portion on second telescoping member 140 to inhibit rotation of connector 150 with respect to second telescoping member 140.

The connector 150 is configured to connect with lighting device (e.g., a lighting accessory or a lighting fixture). For example, aperture 151 of connector 150 may include threads 156 that cooperate with threads 184 of accessory 180's connector 158, although other embodiments include non-threaded connections between connector 150 and accessory 180. While the illustrated embodiment depicts connector 150 as including the female portion and accessory 180 including the male portion of the connection between connector 150 and accessory 180, alternate embodiments of connector 150 include a male portion while accessory 180 includes the complimentary female portion.

Extension device 100 may optionally include a locking member 186. The inner surface of locking member 186 includes threads similar to the threads in aperture 151 of connector 150 and are configured to engage with the same member that engages aperture 151 (e.g., threads 184 of connector 158), and can optionally include a friction enhancing or tool engaging surface to facilitate rotation and tightening of locking member 186 on threads 184. In FIG. 2, locking member 186 is depicted as being registered on lighting accessory 180. However, in other embodiments, locking member 186 can be depicted as being registered on connector 150, such as in embodiments where connector 150 includes the male portion of the connection with accessory 180. Although accessory 180 is depicted as having a base portion 182 and a sensor portion 184, alternate embodiments of accessory 180 can include a different arrangement provided that accessory 180 includes a connector 158 for connecting with connector 150.

The telescoping members optionally include a locking device (e.g., locking device 160), which can be used to set the overall length of extension device 100 as desired. For example, in the illustrated embodiment locking device 160 includes an aperture 162 positioned on (or in) the outer telescoping member (which in the illustrated embodiment is second telescoping member 140) into which a locking member (e.g., pin 164) may be inserted to engage the inner telescoping member (which in the illustrated embodiment is first telescoping member 110). Pin 164 may include a threaded outer surface that allows pin 164 to engage the inner surface of aperture 162 allowing a user to rotate pin 164 and advance pin 164 into engagement with the inner telescoping member to set the length of extension device 110.

In some embodiments, second telescoping member 140 is made of a relatively soft material when compared to pin 164 which may be made of metal, such as some forms of plastic, that may not be sufficiently strong to receive the forces from the threads on pin 164 without deforming when pin 164 is tightened against the first telescoping member 110. In other words, the material used to construct the second telescoping member 140 may be sufficiently soft that the threading inside aperture 162 can strip when pin 164 is tightened against first telescoping member 110. To address this issue, some embodiments include a sleeve 166 constructed of a stronger material (such as metal) attached to the inner surface of aperture 162 (such as by an adhesive) to provide threads that will better resist stripping when pin 164 is tightened against first telescoping member 110.

Although first telescoping member 110 is illustrated as having a solid outer surface, alternate embodiments of first telescoping member 110 may have indentations or apertures for receiving pin 164, which can enhance the locking strength of locking device 160, provide registers for pin 164 at pre-established intervals to aid in setting the overall length of extension device 100 to a pre-established length, or both. However, advantages are also realized by having a solid outer surface of first telescoping member 110 as depicted in FIGS. 1 and 2, which can assist the user in setting the overall length of extension device 100 to any of an infinite selection of lengths.

In at least one example of use of extension device 100, a user (such as an electrician) desiring to attach a lighting accessory (e.g., lighting accessory 180) to a lighting fixture (such as to attach a motion sensor to a high-bay lighting fixture) can thread the wires from the lighting accessory 180 (which are not depicted, but can extend from connector 158 in the example embodiment depicted in FIG. 2) through extension device 100, operatively connect the lighting accessory 180's wires to the lighting fixture, set the length of extension device 100 to a length appropriate for the given installation, and connect the accessory 180 to the lighting fixture using extension device 100. Connection device 100 also has advantages in allowing the user to adjust the distance the accessory 180 is positioned relative to the lighting fixture after the lighting accessory 180 is connected to the lighting fixture.

Since extension device 100 is easily assembled by hand, extension device 100 can facilitate an easier installation by the user. For example, the wires may be threaded through the individual components of extension device 100 prior to connecting the individual components of extension device 100 to one another. Once the electrical wires are operatively connected to the lighting fixture, the user may connect the individual components of extension device 100 to one another to form the assembled extension device 100.

In one example, a user may thread the wires of accessory 180 through connector 158, through aperture 151 of connector 150, through apertures 146 and 142 of second telescoping member 140, through apertures 112 and 116 of first telescoping member 110, through aperture 126 of connector 120, and through the aperture in the lighting fixture to which lighting accessory 180 will be connected. Once the wires are threaded through the individual, unassembled components, the user may operatively connect these wires to the lighting fixture.

Once the wires of accessory 180 are connected to the lighting fixture, the user may rotate connector 158 onto threads 184 of accessory 180, and rotate connector 150 onto connector 158 until achieving sufficient engagement, then optionally rotate locking member 186 until locking member 186 engages connector 150, which will set the relative rotation between accessory 180 and connector 150.

The user may also insert connector 150 (such as with accessory 180 attached) into aperture 146 of second telescoping member 140. In embodiments where connector 150 is keyed to aperture 146 (such as in the illustrated embodiment where key 152 of connector 150 engages notch 147 of aperture 146), connector 150 does not rotate with respect to second telescoping member 140, resulting in accessory 180 not rotating with respect to second telescoping member 140 when locking member 186 is tightened against connector 150. If accessory 180 is tilted at an undesirable angle with respect to locking member 150 and telescoping member 140, the user may untighten locking member 186 with respect to connector 150, rotate accessory 180 to the desired orientation, then tighten locking member 186 against connector 150 to reset the orientation. Since in the illustrated embodiment connector 150 is keyed to second telescoping member 140 and connector 158 is rotationally secured to connector 150 when locking member 186 is tightened against connector 150, accessory 180 will be rotationally secured to connector 150 (and second telescoping member 140) when locking member 186 is tightened against connector 150.

After threading wires through all components of extension device 100, the user may insert the narrower telescoping member (first telescoping member 110 in the illustrated embodiment) into the wider telescoping member (second telescoping member 140 in the illustrated embodiment), slide the two telescoping members together until achieving the appropriate overall length for extension device 100, rotate pin 164 to engage with first telescoping member 110, and set the length of extension device 100 to a desired length.

After threading the wires through the components of connector 110, the user may press connector 120 into aperture 116. In embodiments where the connection between connector 120 and first telescoping member 110 allows relative rotation, the user can rotate connector 120 in relation to first telescoping member 110 to engage the threads of fitting 124 with cooperating threads in the lighting fixture to connect extension device 100 to the lighting fixture which may include rotating connector 120 until connector 120 cannot be rotated further without causing damage. It should also be appreciated that, before connecting connector 120 to first telescoping member 110, the user can engage the threads of fitting 124 with corresponding threads in the lighting fixture and rotate connector 120 until connector 120 is appropriately engaged with the lighting fixture, then press (e.g., snap) telescoping member 110 onto fitting 122 of connector 120. In embodiments where the connection between connector 120 and first telescoping member 110 allows relative rotation between the two, extension device 100 will tend to hang vertically downward due to gravity, which can be desirable in certain installations such as when connecting a sensor to a high-bay lighting device.

In other embodiments, the wires are not part of lighting accessory 180 and can be operatively connected to the lighting fixture before threading the wires through extension device 100 and connecting the wires to the lighting accessory.

In another example, a user can assemble extension device 100 prior to threading the wires through extension device 100.

If included, end caps 118 and 148 may set into first end 114 of first telescoping member 110 and first end 144 of second telescoping member 140, respectively.

Extension device 100 allows a user to connect a lighting accessory 180 to a lighting fixture using multiple variations of the above actions allowing a user to customize how the user connects a lighting accessory to a lighting fixture using extension device 100.

In the illustrated embodiment, aperture 116 of first telescoping member 110 is located adjacent first end 114, and aperture 146 of second telescoping member 140 is located adjacent first end 144. Positioning apertures 116 and 146 near the ends of extension device 100 can be advantageous. For example, the location of aperture 146 near first end 144 of second telescoping member 140 minimizes shadows that may be cast by telescoping member 120 when the lighting fixture to which extension device 100 is connected is illuminated. Using this arrangement, extension device 100 does not unnecessarily extend past the end of the fixture or accessory, which also helps minimize the amount of material when manufacturing extension device 100.

Alternate embodiments of extension device 100 include two or more apertures 146 for connecting multiple lighting devices. To minimize shadowing from the lighting fixture to which extension device 100 and the one or more lighting accessories are connected, the two or more apertures 146 can be positioned on the side of extension device 100 opposite aperture 116, although other embodiments or can be positioned on other surfaces of extension device 100 (e.g., the side surfaces or extension device 100 where no apertures are depicted in FIGS. 1 and 2, or on the same side as aperture 116) to accommodate various uses of extension device 100.

Alternate embodiments of extension device 100 include different forms of locking devices 160 for setting the overall length of extension device 100. For example, some embodiments include raised portions on the outer surface of the inner telescoping member (e.g., the first telescoping member 110 in FIG. 1) and/or the inner surface of the outer telescoping member to increase the friction between the inner telescoping member and the outer telescoping member (e.g., the second telescoping member 140 in FIG. 1). Alternate embodiments include an outer telescoping member sufficiently small in cross section to create sufficient friction between the inner and outer telescoping members to maintain the user's set length of extension device 100 when installed. In further embodiments, the inner telescoping member includes raised portions and the inner surface of the outer telescoping member includes complimentary recessed portions for registering the raised portions of the inner telescoping member. In still further embodiments, the inner surface of the outer telescoping member includes raised portions and the outer surface of the inner telescoping member includes complimentary recessed portions for accommodating the raised portions in the outer telescoping member.

In some embodiments, connectors 120 and 150 connect to the same lighting device, which can provide a type of adjustable external wiring conduit for the lighting device.

Various aspects of different embodiments of the present disclosure are expressed in Statements 1, 2, 3, and 4, as follows:

Statement 1.

One embodiment of the present disclosure includes a lighting fixture extension device, comprising: a first connector configured to couple to a lighting device; a first telescoping member defining a first aperture configured to accept the connector; and a second telescoping member configured to telescopically engage the first telescoping member; wherein the first connector is configured to snap into the first aperture and rotate relative to the first telescoping member.

Statement 2.

Another embodiment of the present disclosure includes an extension device for a lighting accessory, comprising: a first connector configured to couple to a lighting device; a first telescoping member defining a first aperture configured to receive the first connector, wherein the first connector is configured to have a fixed rotational orientation in relation to the first telescoping member when located within the first aperture; a second telescoping member configured to telescopically engage the first telescoping member; and a locking member, wherein the locking member secures the lighting device to the first telescoping member at a rotational orientation selected from a plurality of rotational orientations.

Statement 3.

Another embodiment of the present disclosure includes an extension device for a lighting apparatus, comprising: a first connector configured to couple to a first lighting device; a second connector configured to couple to a second lighting device; a first telescoping member including a first aperture configured to accept the first connector; and a second telescoping member configured to telescopically engage the first telescoping member and including a second aperture configured to accept the second connector; wherein the first connector rotates relative to the first telescoping member when engaged with the first telescoping member; and wherein the second connector is inhibited from rotating relative to the second telescoping member when engaged with the second telescoping member.

Statement 4.

Another embodiment of the present disclosure includes an extension device for a lighting accessory, comprising: a first telescoping member; a second telescoping member configured to telescopically engage the first telescoping member; and means for connecting a first connector to the first telescoping member.

Yet other embodiments include the features described in any of the previous Statements 1, 2, 3, or 4, as combined with (i) one or more of the previous Statements 1, 2, 3, or 4,
(ii) one or more of the following aspects, or
(iii) one or more of the previous Statements 1, 2, 3, or 4, and one or more of the following aspects:

A locking device, wherein the locking device selectively couples the first telescoping member and the second telescoping member to inhibit movement between the first telescoping member and the second telescoping member.

A sleeve connected to the first or second telescoping member and a locking member, wherein the sleeve accepts the locking device and couples to the second telescoping member.

Wherein the second telescoping member defines a second aperture.

A second connector configured to locate within the second aperture and to have a fixed rotational orientation in relation to the second telescoping member when located within the second aperture.

A locking member, wherein the locking member engages the second connector and secures a second lighting device to the second connector at a rotational orientation selected from a plurality of rotational orientations when the locking member is engaged with the second connector.

A locking device, wherein the locking device selectively couples the first telescoping member and the second telescoping member to inhibit movement between the first telescoping member and the second telescoping member.

Wherein the first telescoping member and the second telescoping member rotate relative to one another when the first telescoping member is telescopically engaged with the second telescoping member.

Wherein the first telescoping member and the second telescoping member inhibit rotation relative to one another when the first telescoping member is telescopically engaged with the second telescoping member.

Wherein the first aperture includes a notch or a key, and the first connector includes the other of a notch or a key.

Wherein the notch and the key are configured to mate with one another to hold the first connector in a fixed rotational orientation relative to the first telescoping member when the first connector is snapped into the first aperture.

Wherein the second aperture includes a notch or a key, and the second connector includes the other of a notch or a key.

Wherein the notch and the key are configured to mate with one another to hold the second connector in a fixed rotational orientation relative to the second telescoping member when the second connector is snapped into the second aperture.

Wherein the second connector defines a second aperture.

A second connector configured to rotate relative to the second telescoping member when located within the second aperture.

Wherein the first connector snaps into the first aperture and the second connector snaps into the second aperture.

A sleeve connected to the first or second telescoping member and a locking member, wherein the sleeve accepts the locking device and couples to the second telescoping member.

A locking member, wherein the locking member engages the second connector and secures the second lighting device to the second connector at a rotational orientation selected from a plurality of rotational orientations when the locking member is engaged with the second connector.

Means for connecting a second connector to the second telescoping member.

Means for inhibiting telescopic movement between the first and second telescoping members.

Means for inhibiting rotational movement between the first and second telescoping members.

Means for inhibiting rotation between the second connector and the second telescoping member when the second connector is connected to the second telescoping member.

Means for rotating the first telescoping member in relation to the first telescoping member when the first connector is connected to the first telescoping member.

Reference systems that may be used herein can refer generally to various directions (e.g., upper, lower, top, bottom, forward and rearward), which are merely offered to assist the reader in understanding the various embodiments of the disclosure and are not to be interpreted as limiting. Other reference systems may be used to describe various embodiments.

While examples, one or more representative embodiments and specific forms of the disclosure have been illustrated and described in detail in the drawings and foregoing description, the same is to be considered as illustrative and not restrictive or limiting. The description of particular features in one embodiment does not imply that those particular features are necessarily limited to that one embodiment. Some or all of the features of one embodiment can be used in combination with some or all of the features of other embodiments as would be understood by one of ordinary skill in the art, whether or not explicitly described as such. One or more exemplary embodiments have been shown and described, and all changes and modifications that come within the spirit of the disclosure are desired to be protected.

What is claimed is:

1. A lighting fixture extension device, comprising:

a first connector configured to couple to a lighting device;

a first telescoping member defining a first aperture configured to accept the connector;

a second telescoping member defining a second aperture and configured to telescopically engage the first telescoping member; and a second connector configured to locate within the second aperture;

wherein the first connector is configured to snap into the first aperture and rotate relative to the first telescoping member, the second aperture includes a notch or a key, and the second connector includes the other of a notch or a key, and the notch and the key are configured to mate with one another to hold the second connector in a fixed rotational orientation relative to the second telescoping member when the second connector is snapped into the second aperture.

2. The lighting fixture extension device according to claim 1, comprising:

a locking device, wherein the locking device selectively couples the first telescoping member and the second telescoping member to inhibit movement between the first telescoping member and the second telescoping member.

3. The lighting fixture extension device according to claim 2, comprising:

a sleeve connected to the first or second telescoping member and a locking member, wherein the sleeve accepts the locking device and couples to the second telescoping member.

4. The lighting fixture extension device according to claim 1, wherein the second connector is configured to have a fixed rotational orientation in relation to the second telescoping member when located within the second aperture.

5. The lighting fixture extension device according to claim 4, comprising:

a locking member, wherein the locking member engages the second connector and secures a second lighting device to the second connector at a rotational orientation selected from a plurality of rotational orientations when the locking member is engaged with the second connector.

6. The lighting fixture extension device according to claim 1, wherein the first telescoping member and the second telescoping member rotate relative to one another when the first telescoping member is telescopically engaged with the second telescoping member.

7. The lighting fixture extension device according to claim 1, wherein the first telescoping member and the second telescoping member inhibit rotation relative to one another when the first telescoping member is telescopically engaged with the second telescoping member.

8. An extension device for a lighting accessory, comprising:

a first connector configured to couple to a lighting device;

a first telescoping member defining a first aperture configured to receive the first connector, wherein the first connector is configured to have a fixed rotational orientation in relation to the first telescoping member when located within the first aperture, and wherein the first aperture includes a notch or a key and the first connector includes the other of a notch or a key;

a second telescoping member configured to telescopically engage the first telescoping member; and a locking member, wherein the locking member secures the lighting device to the first telescoping member at a rotational orientation selected from a plurality of rotational orientations;

wherein the notch and the key are configured to mate with one another to hold the first connector in a fixed rotational orientation relative to the first telescoping member when the first connector is snapped into the first aperture.

9. The lighting fixture extension device according to claim 8, comprising:

a locking device, wherein the locking device selectively couples the first telescoping member and the second telescoping member to inhibit movement between the first telescoping member and the second telescoping member.

10. The lighting fixture extension device according of claim 8, wherein the second telescoping member defines a second aperture, the light fixture extension device comprising:

a second connector configured to rotate relative to the second telescoping member when located within the second aperture.

11. The lighting fixture extension device according to claim 10, wherein the first connector snaps into the first aperture and the second connector snaps into the second aperture.

12. An extension device for a lighting apparatus, comprising:

a first connector configured to couple to a first lighting device;

a second connector configured to couple to a second lighting device;

a first telescoping member including a first aperture configured to accept the first connector;

a second telescoping member configured to telescopically engage the first telescoping member and including a second aperture configured to accept the second connector; and a locking member, wherein the locking member engages the second connector and secures the second lighting device to the second connector at a rotational orientation selected from a plurality of rotational orientations when the locking member is engaged with the second connector;

wherein the first connector rotates relative to the first telescoping member when engaged with the first telescoping member; and wherein the second connector is inhibited from rotating relative to the second telescoping member when engaged with the second telescoping member.

13. The lighting fixture extension device according of claim 12, comprising:

a locking device, wherein the locking device selectively couples the first telescoping member and the second telescoping member to inhibit movement between the first telescoping member and the second telescoping member.

14. The lighting fixture extension device according to claim 13, comprising:

a sleeve connected to the first or second telescoping member and a locking member, wherein the sleeve accepts the locking device and couples to the second telescoping member.

15. The lighting fixture extension device according to claim 12, wherein the first connector snaps into the first aperture and the second connector snaps into the second aperture.

16. The lighting fixture extension device according to claim 12, wherein the first telescoping member and the second telescoping member rotate relative to one another when the first telescoping member is telescopically engaged with the second telescoping member.

17. The lighting fixture extension device according to claim 12, wherein the first telescoping member and the second telescoping member inhibit rotation relative to one another when the first telescoping member is telescopically engaged with the second telescoping member.

18. A lighting fixture extension device, comprising:

a first connector configured to couple to a lighting device;

a first telescoping member defining a first aperture configured to accept the connector, wherein the first connector is configured to snap into the first aperture and rotate relative to the first telescoping member;

a second telescoping member defining a second aperture and configured to telescopically engage the first telescoping member;

a second connector, wherein the second connector is configured to locate within the second aperture and to have a fixed rotational orientation in relation to the second telescoping member when located within the second aperture; and a locking member, wherein the locking member engages the second connector and secures a second lighting device to the second connector at a rotational orientation selected from a plurality of rotational orientations when the locking member is engaged with the second connector.

19. The lighting fixture extension device according to claim 18, comprising:

a locking device, wherein the locking device selectively couples the first telescoping member and the second telescoping member to inhibit movement between the first telescoping member and the second telescoping member.

20. The lighting fixture extension device according to claim 19, comprising:

a sleeve connected to the first or second telescoping member and a locking member, wherein the sleeve accepts the locking device and couples to the second telescoping member.

21. The lighting fixture extension device according to claim 18, wherein the first telescoping member and the second telescoping member rotate relative to one another when the first telescoping member is telescopically engaged with the second telescoping member.

22. The lighting fixture extension device according to claim 18, wherein the first telescoping member and the second telescoping member inhibit rotation relative to one another when the first telescoping member is telescopically engaged with the second telescoping member.

* * * * *